US006981906B2

(12) United States Patent
Hashish et al.

(10) Patent No.: US 6,981,906 B2
(45) Date of Patent: Jan. 3, 2006

(54) METHODS AND APPARATUS FOR MILLING GROOVES WITH ABRASIVE FLUIDJETS

(75) Inventors: Mohamed A. Hashish, Bellevue, WA (US); Steven J. Craigen, Auburn, WA (US); Timothy J. Ennis, Kent, WA (US); Thomas E. Nettekoven, Kaukauna, WI (US); Michael W. Van Laanen, Green Bay, WI (US)

(73) Assignees: Flow International Corporation, Kent, WA (US); The C. A. Lawton Co., De Pere, WI (US)

( * ) Notice: Subject to any disclaimer, the term of this patent is extended or adjusted under 35 U.S.C. 154(b) by 0 days.

(21) Appl. No.: 10/602,535

(22) Filed: Jun. 23, 2003

(65) Prior Publication Data

US 2004/0259478 A1 Dec. 23, 2004

(51) Int. Cl.
*B24C 1/00* (2006.01)

(52) U.S. Cl. ..... 451/2; 451/38; 451/39; 451/40; 451/37; 451/102

(58) Field of Classification Search ..... 451/2, 451/37–40, 102, 36; 83/53, 177; 299/17
See application file for complete search history.

(56) References Cited

U.S. PATENT DOCUMENTS

| | | | | |
|---|---|---|---|---|
| 2,618,989 A | | 11/1952 | Cupler, II | |
| 3,168,848 A | | 2/1965 | Bardenhagen et al. | |
| 3,540,166 A | | 11/1970 | Crumley | |
| 3,709,436 A | | 1/1973 | Foster | |
| 3,726,481 A | | 4/1973 | Foster et al. | |
| 3,756,106 A | | 9/1973 | Chadwick et al. | |
| 3,897,002 A | | 7/1975 | Witty | |
| 3,960,407 A | | 6/1976 | Noren | |
| 3,997,111 A | | 12/1976 | Thomas et al. | |
| 4,097,000 A | | 6/1978 | Derr | |
| 4,111,490 A | * | 9/1978 | Liesveld | 299/17 |
| 4,150,794 A | | 4/1979 | Higgins | 239/596 |
| 4,196,858 A | | 4/1980 | Schulze et al. | 239/522 |
| 4,216,906 A | | 8/1980 | Olsen et al. | 239/11 |
| 4,508,577 A | | 4/1985 | Conn et al. | 134/1 |
| 4,537,639 A | | 8/1985 | Shook | 134/10 |
| 5,116,425 A | | 5/1992 | Ruef | 134/17 |
| 5,167,721 A | | 12/1992 | McComas et al. | 134/32 |
| 5,380,068 A | | 1/1995 | Raghavan | 299/17 |
| 5,724,824 A | | 3/1998 | Parsons | 62/171 |
| 5,992,404 A | * | 11/1999 | Bleyer et al. | 125/26 |

(Continued)

FOREIGN PATENT DOCUMENTS

DE 27 36 314 A1 2/1979

(Continued)

OTHER PUBLICATIONS

Hashish, "Deep Kerfing Concepts With Penetrating Abrasive-Waterjet Nozzles," *Proceedings of the Canadian Congress of Applied Mechanics*, Alberta, Canada, 1987, 2 pages.

(Continued)

*Primary Examiner*—George Nguyen
(74) *Attorney, Agent, or Firm*—Seed Intellectual Property Law Group PLLC

(57) ABSTRACT

A method for milling grooves in a work-piece includes using a manipulator to control impingement angles of abrasive fluidjets traversed across the work-piece. Another method employs multiple fluidjets simultaneously with a plurality of impingement angles. An apparatus is also provided to allow for the simultaneous use of multiple abrasive fluidjets with a plurality of impingement angles.

8 Claims, 11 Drawing Sheets

U.S. PATENT DOCUMENTS 6,422,920 B1 * 7/2002 Bouten et al. ..... 451/29
6,705,921 B1 * 3/2004 Shepherd ..... 451/2

FOREIGN PATENT DOCUMENTS

FR 989.083 9/1951

OTHER PUBLICATIONS

Hashish et al., "Abrasive-Waterjet Deep Kerfing in Concrete for Nuclear Facility Decommissioning," *Proceedings of the Third U.S. Water Jet Symposium*, Pittsburgh, PA, May 1985, 22 pages.

Hashish et al., "Development of Abrasive-Waterjet Concrete Deep Kerf Tool for Nuclear Facility Decommissioning," *Proceedings of the International Water Jet Symposium*, Water Jet Technology Association, Beijing, China, Sep. 1987, pp. 4-11 to 4-33.

High Energy Jets Limited brochure, "A Technical Breakthrough in Fan Jets, a New Concept in Nozzle Design, " undated.

* cited by examiner

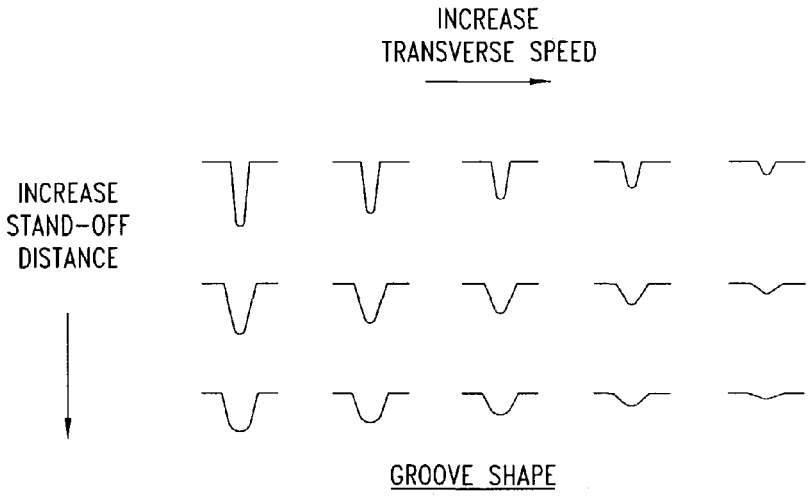
*Fig. 3 (Prior Art)*
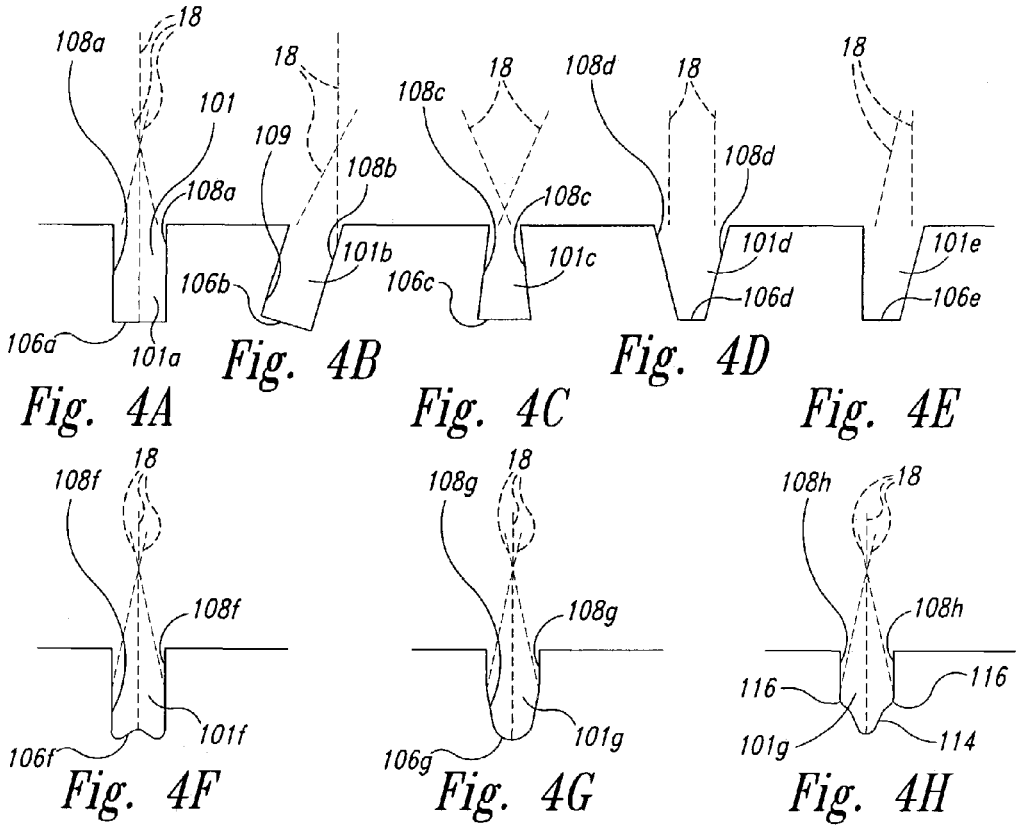
*Fig. 4A* *Fig. 4B* *Fig. 4C* *Fig. 4D* *Fig. 4E*
*Fig. 4F* *Fig. 4G* *Fig. 4H*

METHODS AND APPARATUS FOR MILLING GROOVES WITH ABRASIVE FLUIDJETS

BACKGROUND OF THE INVENTION

1. Field of the Invention

The following invention relates to milling grooves in work-pieces, and in particular, milling grooves using abrasive fluidjets.

2. Description of Related Art

Groove milling is employed in fabrication processes for a wide variety of industrial and mechanical equipment. Some examples of equipment for which groove shapes are critical include refiner plates, which are widely used in the pulp and paper industry, and heat sinks in the advanced jet engine industry. In the pulp and paper industry, wood chips are often mechanically processed by passing the chips between rotating refiner plates. The shape of grooves in the refiner plates impacts hydraulic characteristics of the plate that can be critical to the capacity and efficiency of the plate as well as the characteristics of the pulp processed. For heat sinks, the shape of grooves in heat sinks can be critical in heat transfer efficiency.

Abrasive fluidjets can be used for groove milling and offer distinct advantages over conventional machining of grooves. These advantages include reduced fire hazards, reduced power consumption, and high accuracy. At the same time, however, unique challenges are presented in the use of abrasive fluidjets. These include controlling the erosive action of the abrasive fluidjets beyond a certain specified depth; controlling the shape of the groove milled; and properly overlapping the impact of abrasive fluidjets on a surface to produce a groove area larger than the abrasive fluidjet footprint.

Available abrasive fluidjet methods and devices have been inadequate. The shape, contour, and surface quality of the grooves milled are not controlled. The walls of the grooves are tapered with the upper edges being rounded. Also, the bottoms are rough or rounded. These uncontrolled characteristics are undesirable, such as for refiner plates where they reduce capacity and efficiency of the plates as well as produce undesirable characteristics in the pulp processed. There is a need for an improved abrasive fluidjet milling method and apparatus.

BRIEF SUMMARY OF THE INVENTION

In one embodiment of the present invention, a manipulator can be used to tilt an abrasive fluidjet device while traversing it over a work-piece to orient an abrasive fluidjet emitted therefrom such that it impinges on the work-piece at an impingement angle. The angles of impingement can be lateral (side) angles or longitudinal (leading or trailing) angles of impingement with respect to the direction of traverse, or combinations thereof.

A traversing strategy can be used to execute a plurality of milling passes over the work-piece using the abrasive fluidjet. The traversing strategy can include controlling or adjusting the impingement angles with which the abrasive fluidjet impinges on the work-piece for each pass, the impingement angles being selected depending on the desired shape and surface quality of the groove.

In some embodiments of the invention, various other control parameters are also adjusted to control the shape of the groove. These parameters include, but are not limited to, stand-off distances for the abrasive fluidjet device, strength of the abrasive fluidjet, the speed of the passes, and the flow of abrasive to the abrasive fluidjet. Each of these parameters, including the impingement angles described above, can be controlled in a variety of combinations, excluding or including control of any of the parameters.

In other embodiments of the present invention, multiple abrasive fluidjet devices are used in combination and traversed across a work-piece simultaneously. This allows simultaneous impingement of a plurality of abrasive fluidjets on a work-piece at a plurality of impingement angles and along a plurality of impingement lines on the work-piece. The impingement angles of the multiple abrasive fluidjets can be fixed with respect to the work-piece, or can be adjusted using a manipulator during execution of a traversing strategy.

In some embodiments, a multiple jet assembly is provided. The assembly comprises a plate, retaining pieces, and a plurality of abrasive fluidjet devices. Each of the retaining pieces is mounted on top of the plate for securing an abrasive fluidjet device to the plate. There is at least a forward retaining piece, a center retaining piece, and a rearward retaining piece. Each of the forward and rearward retaining pieces orient abrasive fluidjet devices disposed therein with positive or negative lateral angles as well as lead or trailing longitudinal angles.

BRIEF DESCRIPTION OF SEVERAL VIEWS OF THE DRAWING(S)

FIG. 3 shows cross sectional views of typical groove shapes generated by the prior art.

FIGS. 4A–4H are cross sectional views of some groove shapes attainable by use of the present invention, showing the orientation of the abrasive fluidjets used during at least some passes to achieve the groove shapes.

DETAILED DESCRIPTION OF THE INVENTION

In the following description, certain specific details are set forth in order to provide a thorough understanding of various embodiments of the invention. However, upon reviewing this disclosure, one skilled in the art will understand that the invention may be practiced without many of these details. In other instances, well known structures associated with abrasive fluidjets, traversing assemblies, and robotic manipulators have not been described in detail to avoid unnecessarily obscuring the description of the embodiments of the invention.

Terms in the following description related to orientation such as "forward" and "rearward," "positive" and "negative," "leading" and "trailing," "left" and "right," as well as any coordinates and axes (i.e. "X," "Y," and "Z") are only intended to describe the position or orientation of elements in relation to the figures in which they are illustrated, unless the context indicates otherwise. Also, all ranges disclosed include any range, integer, or fraction, within the disclosed range.

Methods and apparatus are disclosed herein for controlling the shape and surface quality of grooves or cavities milled with abrasive fluidjets. Various critical parameters controlled in some embodiments of the present invention are set forth and defined, and a variety of non-limiting examples of groove shapes that can be milled by controlling the parameters are provided.

In overview, some embodiments of the present invention are carried out using a manipulator to tilt an abrasive fluidjet device while traversing it over a work-piece to control or select an impingement angle. The impingement angle can be a lateral angle or longitudinal angle (defined infra) with respect to the direction of traverse, or a combination thereof. In other embodiments, an apparatus is provided to retain a plurality of abrasive fluid jet devices in close proximity to one another, with at least two of the devices fixedly oriented so as to provide different angles of impingement for the abrasive fluidjets emitted therefrom. As will be appreciated by one skilled in the art after reviewing the present disclosure, these embodiments of the present invention, as well as other embodiments disclosed, can be used separately or in combination to provide a user with the ability to control the shapes of grooves milled, including controlling wall taper, depth, overall contour, and surface quality.

Figure 1:
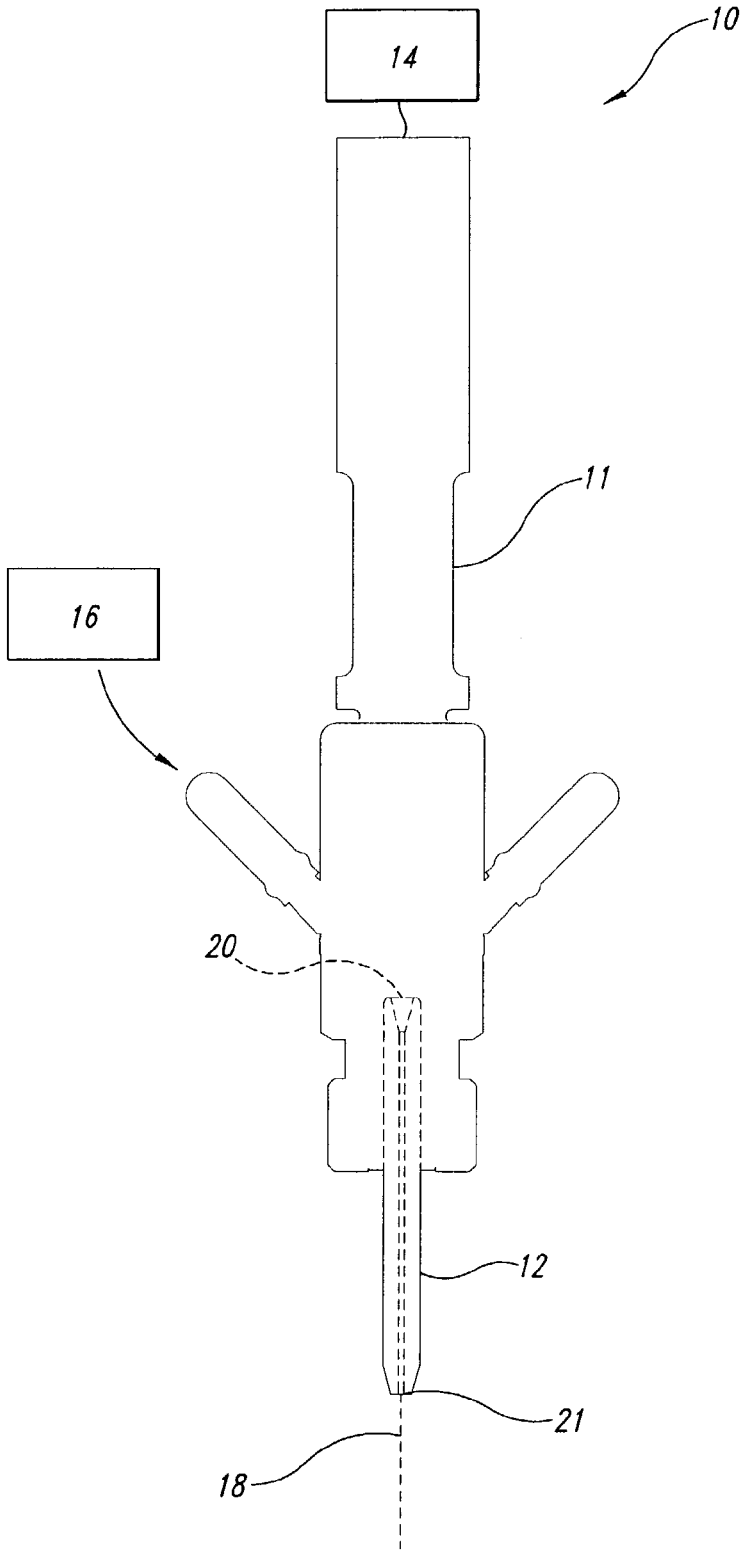
Fig. 1 (Prior Art)
FIG. 1 is a side elevation view of a prior art abrasive fluidjet device that may be used with the present invention.

Various embodiments of the invention employ currently available abrasive fluidjet devices, similar to that illustrated in FIG. 1, hereinafter referred to as an AFJD 10. The abrasive fluidjet device, or AFJD 10, comprises a body 11 and a nozzle 12, or mixing tube, that forms an end portion of the AFJD 10. The nozzle 12 is attached to the body 11 of the AFJD and has an inlet end portion 20 within the body 11 of the AFJD 10 and a discharge end portion 21, opposite the inlet end portion, extending past the end of the body 11.

A high-pressure fluid source 14 is coupled to the AFJD 10. There is an orifice (not shown) within the body 11 of the AFJD 10 through which fluid from the high pressure fluid source can pass to produce a fluidjet. The fluidjet is axially aligned with the nozzle 12 and passes through an interior axial channel of the nozzle. To enhance the ability of the fluidjet to cut through material on a work-piece during a milling process, an abrasive source 16 is coupled to and communicates with the AFJD 10 to allow abrasives to be dispersed into the fluidjet within the AFJD 10. The abrasives mix with the fluidjet in the nozzle 12 to form an abrasive fluidjet 18 that is emitted from a discharge end portion 21 of the nozzle 12.

Figure 2A:
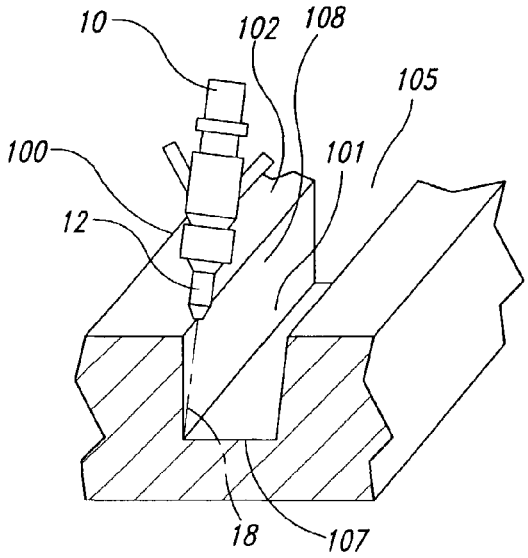
FIGS. 2A is an isometric view of an abrasive fluidjet device oriented to provide a negative lateral impingement angle and positioned at the end of a pass over a work-piece.
Figure 2B:
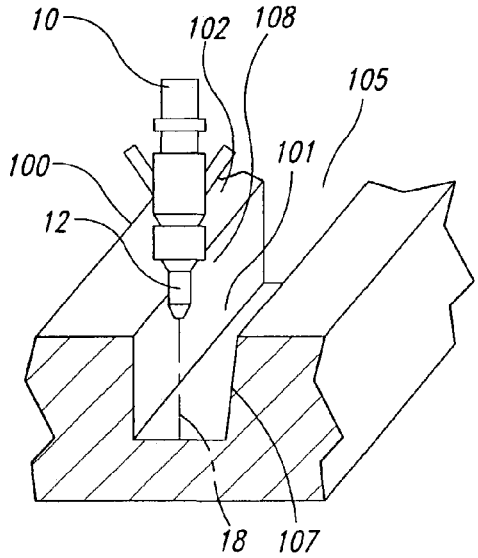
FIG. 2B is an isometric view of an abrasive fluidjet device at the beginning of a pass over a work-piece, with the abrasive fluidjet emitted at zero lateral angle (note that the figure displays the groove shape desired and not the contour of the groove before completion of the pass).

In some embodiments of the present invention, one or more AFJDs 10 are employed to mill grooves 101 in a work-piece 100, as shown in FIGS. 2A and 2B. Each AFJD 10 is carried over a surface 102 of the work-piece 100 in one or more passes, while an abrasive fluidjet 18 is emitted from the AFJD 10 and directed at the work-piece 100. The abrasive fluidjet 18 impinges on the work-piece 100 and removes material therefrom, thus forming a groove 101 in the work-piece 100. Each pass can involve traversing the abrasive fluidjet 18 along the work-piece from a first end portion 105 of a groove 101 that is desired, to a second end portion 107 thereof, or conversely, from the second end portion to the first end portion (for purposes of illustration, FIGS. 2A and 2B, as well as FIGS. 2C, 2D, 4A–4H, 5A and 5B represent grooves after they have been milled rather than prior to execution of passes). The AFJD 10 can be carried over the work-piece using a manipulator or traversing assembly (discussed in detail infra).

Many embodiments of the invention are described in the context of milling straight grooves 101. This can involve carrying the AFJD 10 along a straight line during each pass such that an impingement line of the abrasive fluidjet 18 on the work-piece is also a straight line. However, as will be appreciated by one skilled in the art after reviewing the present disclosure, various manipulators or traversing assemblies may also be employed to carry the AFJD 10 along curved lines to mill curved grooves.

Figure 2C:
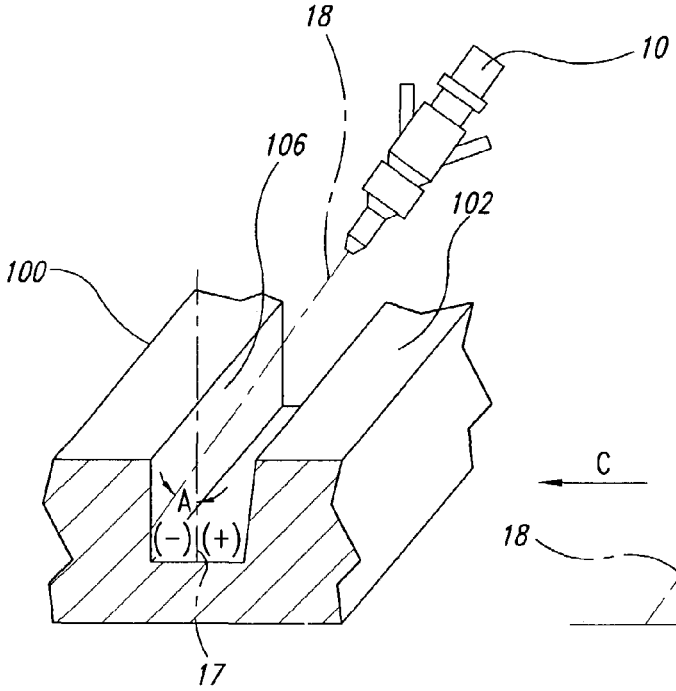
FIG. 2C is an isometric view of an abrasive fluidjet device emitting an abrasive fluidjet at a negative lateral angle angle "A," as measured from a vertical line 17.
Figure 2D:
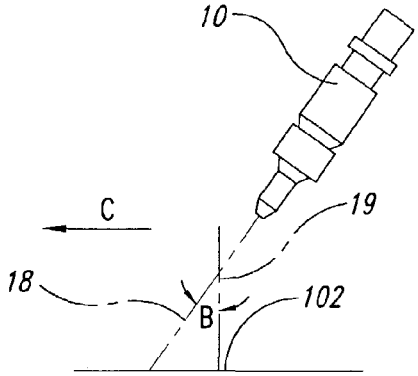
FIG. 2D is a side elevation view of an abrasive fluidjet device passing over a work-piece with a lead angle "B" as measured from a vertical line 19. The arrow "C" in the figure indicates the direction of travel.

In some embodiments, a traversing strategy is employed requiring the execution of a series of passes. Each pass can be executed using a selected impingement angle with which the abrasive fluidjet 18 impinges against the work-piece. The impingement angle can be a negative or positive lateral angle or a lead or trailing longitudinal angle. As best illustrated in FIG. 2C, a lateral angle "A" is the angle between a longitudinal axis of the abrasive fluidjet 18 and an imaginary vertical line 17, or centerline, intersecting the abrasive fluidjet, as viewed against a vertical lateral plane across the groove 101. The AFJD 10 can be tilted so that the lateral angle is positive (+) (angled to the right of the vertical line 17), negative (−) (angled to the left of the vertical line 17), or zero (aligned with the vertical line 17). As best seen in FIG. 2D, the longitudinal angle is defined herein as an angle between a longitudinal axis of the abrasive fluidjet 18 and a vertical line 19, or centerline, as viewed against a longitudinal vertical plane that is parallel to the line of travel, "C," of the AFJD 10. The AFJD 10 can be tilted so that the longitudinal angle "B" is a leading angle (angled forward of the vertical line 19), as illustrated in FIG. 2D, a trailing angle (angled rearward of the vertical line 19), or zero (aligned with the vertical line 19). Both trailing and leading angles can have the effect of increasing a material removal rate of the abrasive fluidjet 18 as compared to a zero. longitudinal angle. The impingement angle for the abrasive fluidjet 18 can comprise a negative or positive lateral angular component as well as a lead or trailing longitudinal angular component during any pass. Stated another way, the abrasive fluidjet 18 can be oriented at any angle and in any direction away from a vertical longitudinal axis, and the orientation can be characterized by a combined lateral angular component and a longitudinal angular component where those components can be negative, positive, leading, trailing, or zero angles.

In some embodiments, a first pass of the traversing strategy is executed with the abrasive fluidjet 18 oriented with a negative lateral angle, as shown in FIG. 2A. The abrasive fluidjet 18 is traversed from a starting point on the work-piece to an end point, while maintaining the negative lateral angle, thereby beginning the formation of a groove 101 having a first end portion 105 adjacent the starting point and a second end portion 107 adjacent the end point. At, or proximate, the second end portion 107 of the groove 101, the lateral angle of the AFJD 10 is adjusted to a positive lateral angle (not shown) and a second pass over the work-piece is executed with the positive lateral angle by traversing the abrasive fluidjet 18 back to the first end portion 105 of the groove 101. Also, a third pass can be executed with zero lateral angle with the abrasive fluidjet 18 traversed along a center impingement line within the groove 101, as shown in FIG. 2B. This embodiment of a traversing strategy can produce a groove with controlled wall taper. Any number of passes can be executed with any combination of the impingement angles described above. Non-limiting examples include executing at least a plurality of passes at each of a negative and positive lateral angle, and then executing at least one pass using a zero lateral angle. In other embodiments, several passes are also executed using a zero lateral angle.

Furthermore, trailing or leading angles can be used in any combination with the lateral angles discussed above to increase material removal rate, or decrease material removal rate. This can increase or decrease depth of the groove respectively, along an impingement line. A leading or trailing angle can be employed for some passes in combination with a positive or negative lateral angle, while for others, the leading or trailing angle can be reduced or the abrasive fluidjet 18 can be adjusted to zero longitudinal angle.

The traversing strategy can also include moving, or shifting, the AFJD 10 laterally after the completion of a groove 101 to begin a next series of passes for a next groove along a different line of impingement. In some embodiments, the AFJD 10 can be shifted laterally during or between passes for a single groove 101, which can shift an impingement line along the groove being milled. Shifting impingement lines between passes can be used to widen a groove, and moving impingement lines during a pass can be used to form curved grooves. In some embodiments, the lateral angle is adjusted while the AFJD is shifted laterally to maintain substantially the same impingement line but with a different lateral angle.

Other control parameters can also be adjusted on each pass as part of the traversing strategy. For example, stand-off distance of the AFJD 10 from the surface of the work-piece 100 can be adjusted. The stand-off distance is the distance of the nozzle 12 from the surface of the work-piece 100 against which the abrasive fluidjet 18 impinges. Increasing stand-off distance can decrease material removal rate during a pass. The traversing speed of the AFJD 10 can also be adjusted. Increasing speed can lower material removal during a pass, but can also result in more uniform surfaces. Still further control parameters that can be adjusted to control groove 101 shape and quality include the fluid pressure or fluid flow rate of fluid supplied to the AFJD 10, the abrasive flow rate or abrasive qualities, such as the size and material of the abrasive, and the mixing characteristics of the abrasive within the abrasive fluidjet 18, which can be pre-selected by changing the length and diameter of the mixing tube 12 used with the AFJD 10 (discussed in detail below). As will be appreciated by one skilled in the art after reviewing the present disclosure, many of the control parameters discussed above can be controlled or adjusted for any pass of a traversing strategy in any sequence desired to achieve a desired shape and surface quality for a groove. Some specific non-limiting examples of groove shapes milled with various embodiments of the present invention are discussed below.

In order to appreciate the significant improved results of the present invention over the prior art, it is instructive to first view FIG. 3 to contrast the grooves in that figure with the groove shapes attainable with the present invention, described hereinafter. The grooves shown in FIG. 3 all have tapered walls with slightly rounded upper edges. In addition, although not shown in FIG. 3, the bottoms may be typically rough and rounded.

In contrast with the prior art groove shapes shown in FIG. 3, some representations of groove shapes that can be generated by embodiments of the present invention disclosed thus far are shown in FIGS. 4A–4H. As can be seen, the present invention can, inter alia, control wall taper or grooves, sharpen groove edges, and produce grooves with flat bottom surfaces. In each of FIGS. 4A–4H, multiple abrasive fluidjets 18 are shown to be impinging in the grooves 100; however, these combinations of abrasive fluidjet 18 orientations can be achieved by manipulating a single abrasive fluidjet 18 over a plurality of passes.

As illustrated in FIG. 4A, a combination of a plurality of passes with an even number of positive and negative lateral angles and at least one zero lateral angle pass may produce a groove 101*a* with straight walls 108*a* and a substantially flat bottom surface 106*a*. As illustrated in FIG. 4B, a tapered wall 108*b* on one side of the groove 101*b*, combined with a straight undercut wall 109 on the other side of the groove may be accomplished by using multiple passes with at least one zero lateral angle pass with an off center impingement line and at least only one of a negative or positive lateral angle, pass. FIG. 4C shows a groove 101*c* with two undercut straight walls 108*c*, which can be formed by using multiple passes at higher degree negative and positive lateral angles than for the embodiment of FIG. 4A. FIG. 4D shows both walls 108*d* of a groove 101*d* being tapered with a flat bottom surface 106*d*, which may be formed by using multiple passes with different lines of impingement while retaining a zero lateral angle. FIG. 4E shows a groove 101*e* with one tapered wall 110 and one straight wall 108*e*, which can also be formed by using a traversing strategy with only a negative or positive lateral angle pass in combination with a zero lateral angle pass to form the tapered wall 110.

FIGS. 4F–4H show grooves with convexly or concavely rounded bottom surfaces that can be milled with the present invention. FIG. 4F shows a groove 101*f* with straight transverse walls 108*f* and a convexly rounded bottom surface 106*f*. One way to achieve the convexly rounded bottom surface in the first embodiment is by limiting, or reducing, the number of passes of the abrasive fluidjet 18 with zero lateral angle in comparison to the number of passes at positive or negative lateral angle. Another way is to increase traversing speed during zero lateral angle pass to decrease material removal during that pass. Furthermore, the strength of the abrasive fluidjet 18 can be reduced for the zero lateral angle pass. The groove illustrated in FIG. 4G includes a concave rounded bottom surface 106*g*. In contrast with the traversing strategy for the groove in FIG. 4F, the concave rounded surface 106*g* may be achieved by using a higher number of passes with zero lateral angle over the center of the groove, than for the groove of FIG. 4F. In FIG. 4H, a secondary slot 114 is present in the bottom surface of the groove. The secondary slot can be achieved by reducing the material removal rates at the outer perimeters 116 of the bottom of the groove 101*g* relative to the removal rate at the center of the groove 101*g*. This can also be done by adjusting any of the control parameters described above, including using a reduced number of passes with positive and negative tilt angles to lower the amount of outer perimeter 116 material removed.

Again, as will be appreciated by one skilled in the art after reviewing the present disclosure, any of the multiple control parameters previously described can be manipulated independently, or in combination, to control the size, shape or surface quality (e.g. roughness) of the groove milled. The shape of the groove includes the contour of the groove surface as well as the depth or width of the groove. However, various shapes cannot be attained without adjusting the lateral angle of the AFJD 10 used, such as, for example, those shapes having straight, untapered walls, or undercut walls. The combinations of lateral angles, their degrees (i.e. from the vertical line 17), and numbers of passes can vary widely depending on groove shapes desired, material of the work-piece, and the settings of other control parameters.

Typical material of construction for a refiner plate work-piece will be 17-4Ph Stainless Steel. Typical grooves for refiner plates will have groove depths of about 0.25 to about 0.5 inches, and groove widths of about 0.1 to about 0.3 inches. In addition, when parallel walls are desired, the typical tolerance as to variation from ideal spacing between the walls, or wall parallelism, is about 0.001 inches to 0.002 inches. These typical specifications can be accurately attained using embodiments of the methods described herein.

It is noted that in some embodiments of the invention, grooves may be milled into the refiner plates before the refiner plates have been cut into their desired shapes. The plates may then be cut later, resulting in time saved. In other embodiments, the plates are milled after cutting.

Figure 6:
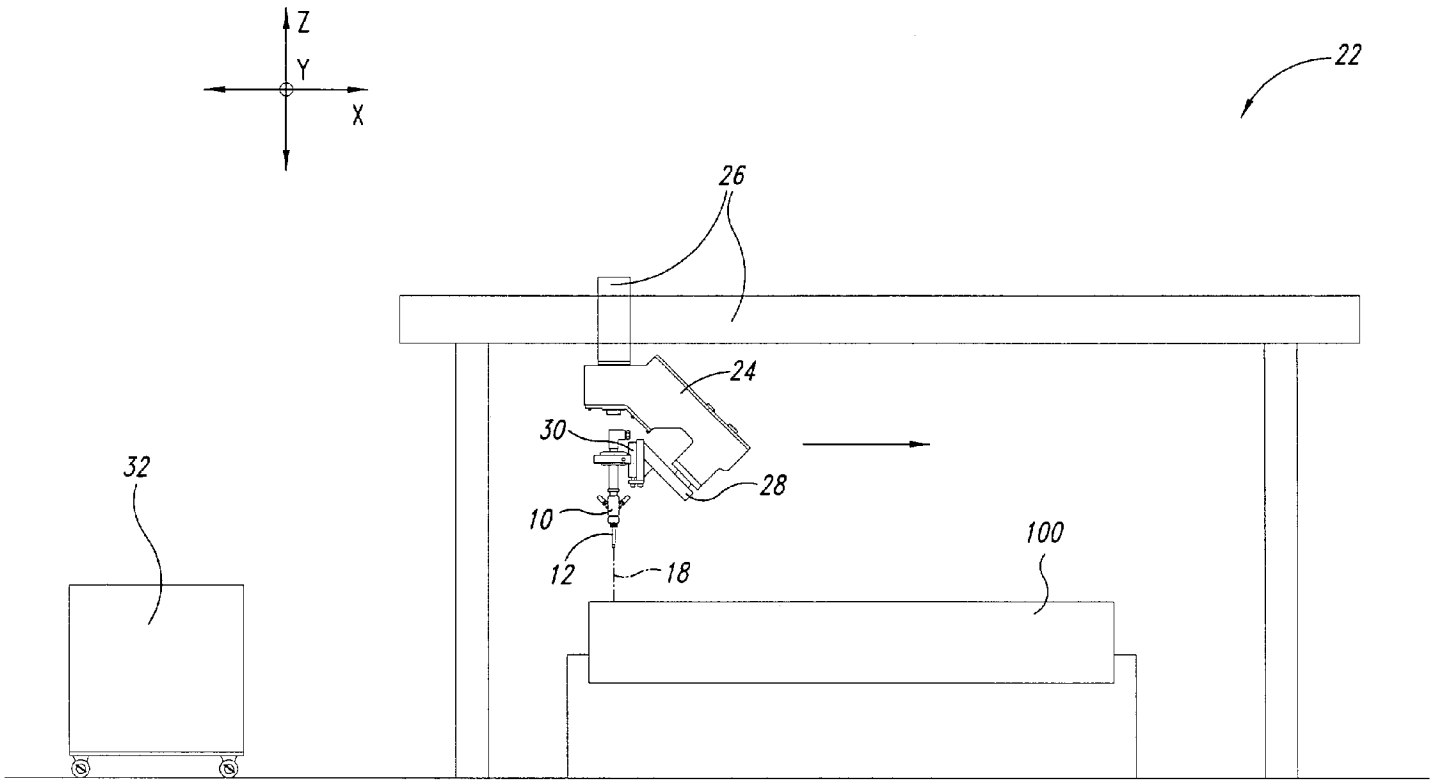
FIG. 6 is a side elevation view of a typical manipulator positioned over a work-piece to be used in the present invention.

Some embodiments of the present invention can be implemented using a variety of manipulators to carry the AFJDs 10 and adjust, their positions and impingement angles. FIG. 6 is a simplified representation of a FLOW ROBOTICS manipulator disposed over a work-piece for milling grooves in the work-piece. The AFJD 10 is attached to a manipulator 22 that is configured to carry the AFJD 10 over the surface of the work-piece 100. The manipulator 22 can be used to selectively adjust the impingement angles, impingement line, and standoff distance of the abrasive fluidjet 18 emitted from AFJD 10 during or between passes of a traversing strategy.

The manipulator 22 comprises a carrier arm 24, a pivoting holder 28, and a mounting assembly 30 to which the AFJD 10 is removably mounted. A traversing assembly 26 is provided to which the carrier arm 24 is pivotally attached and from which the carrier arm 24 extends downward. The carrier arm 24 can pivot in relation to the traversing assembly 26 about a vertical axis. Also, the holder 28, which is pivotally connected to a lower end portion of the carrier arm 24, can pivot in relation to the carrier arm. The mounting assembly 30 is attached to the holder 28 and AFJD 10 is removably attached to the mounting assembly 30.

Figure 7:
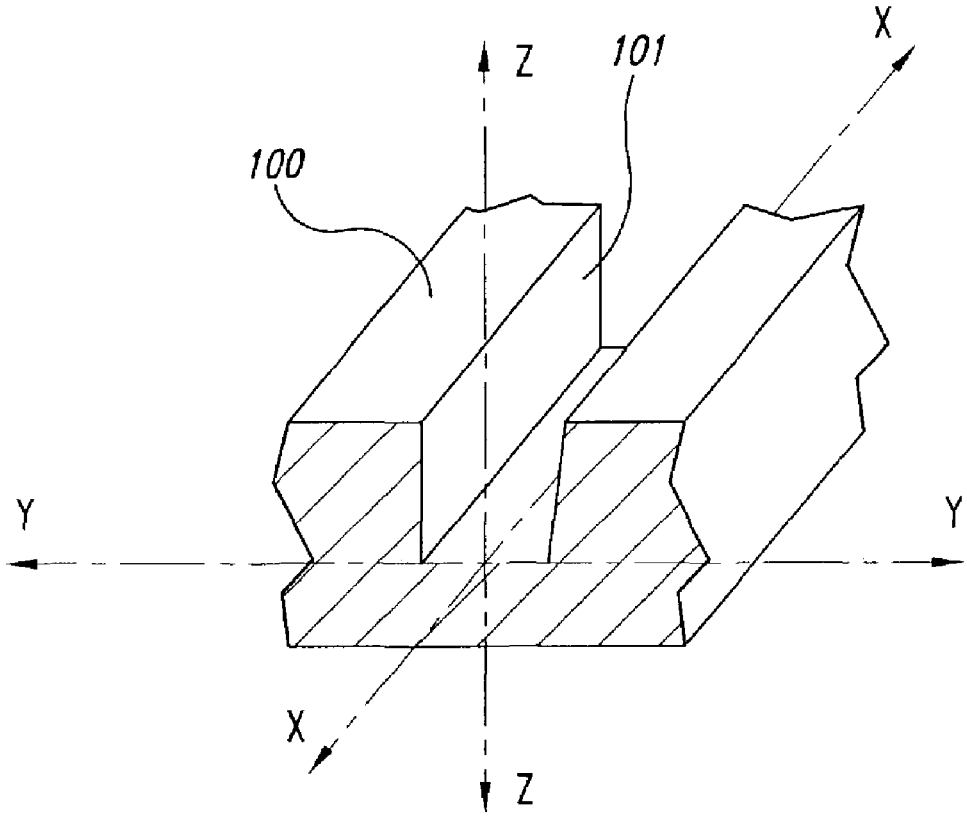
FIG. 7 is an isometric view of a work-piece with a groove, illustrating "X," "Y," and "Z" axes over which an abrasive fluidjet device can be carried by various traversing assemblies, including the manipulator of FIG. 6.

During operation of the AFJD 10 using the manipulator 22, a work-piece 100 is disposed below the AFJD 10, as seen in FIG. 6. FIG. 7 is a cut away isometric view of the work-piece 100 with a desired groove 101, illustrating three axes "X," "Y," and "Z," in which the AFJD 10 can be carried by the manipulator. The three axes are also represented in the side view of the manipulator 22 in FIG. 6. Also, the aforementioned pivoting connections between the carrier arm 24 and the traversing assembly 26, and holder 28 and the carrier arm 24, permit the AFJD 10 to be selectively adjusted to impart the longitudinal angles and lateral angles discussed previously for the abrasive fluidjet 18 emitted from the AFJD 10. As will be appreciated by one skilled in the art upon reviewing this disclosure, the various embodiments of the method set forth herein requiring manipulation of the AFJD 10 to control impingement angles, impingement lines, and stand-off distance can be controlled using the manipulator 22 or other available manipulators.

In one embodiment, the manipulator 22 is coupled to a controller 32. The controller can be preprogrammed to execute a predefined traversing strategy for each work-piece 100 disposed below the manipulator 22. The traversing strategy can comprise manipulating any combination of, or all of the control parameters heretofore mentioned, including additional control parameters.

Figure 8A:
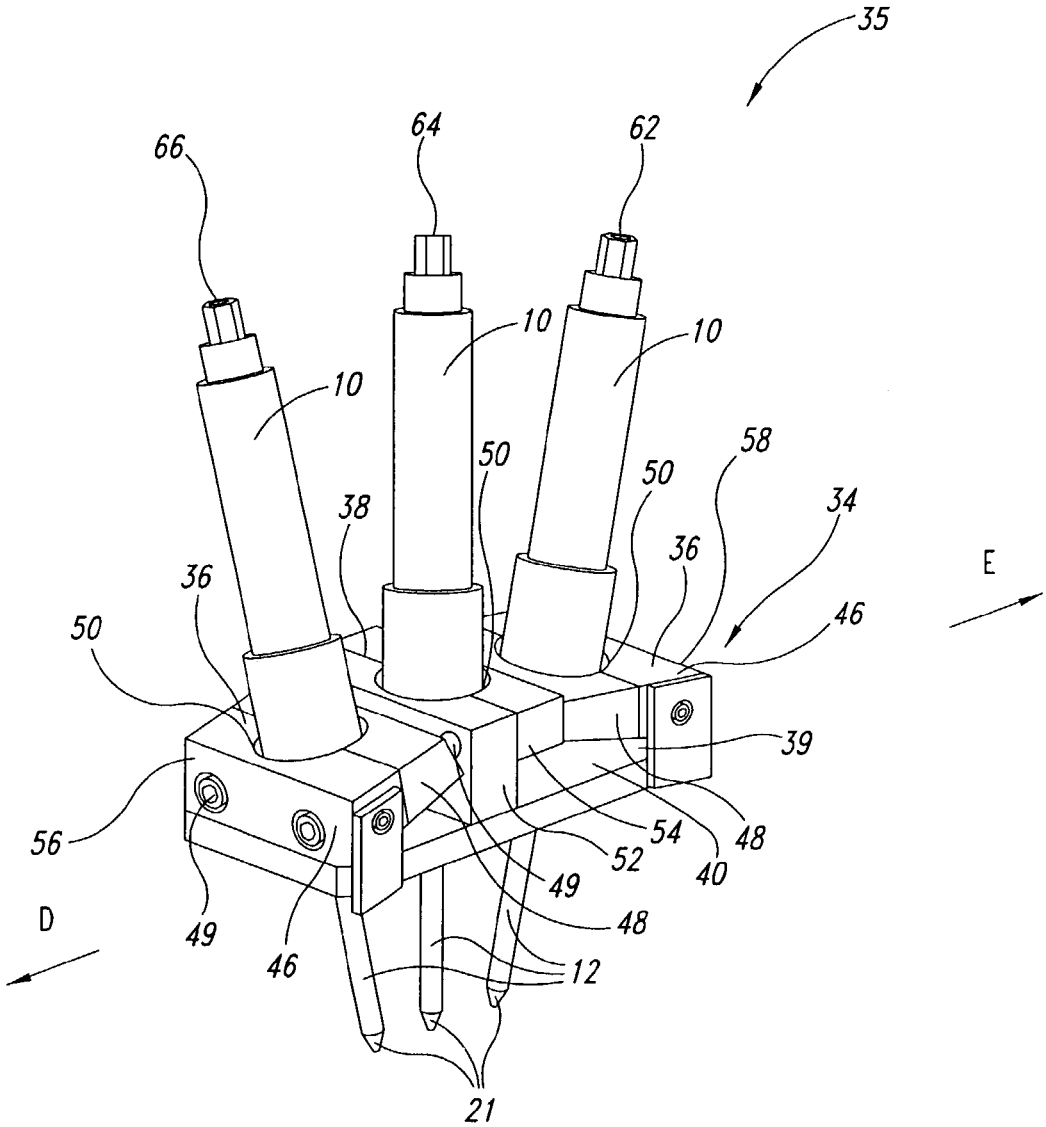
FIG. 8A is an isometric view of an embodiment of a multiple jet assembly provided in accordance with the present invention.

Other embodiments of the present invention do not require a manipulator capable of adjusting lateral and longitudinal angles. These embodiments only require three or two axes traversing assemblies capable of carrying an AFJD along the three axes ("X," "Y," "Z"), or along only two axes ("X," "Y"). One such embodiment is illustrated in FIG. 8A. FIG. 8A depicts a multiple jet mounting assembly 34 in which three AFJDs 62, 64, 66 are mounted together to form a multiple jet assembly 35. The multiple jet assembly 35, or apparatus, can be carried across a work-piece to execute passes wherein a plurality of abrasive fluidjets emitted therefrom simultaneously impinge on the work-piece at a plurality of pre-selected impingement angles and impingement lines.

Figure 9:
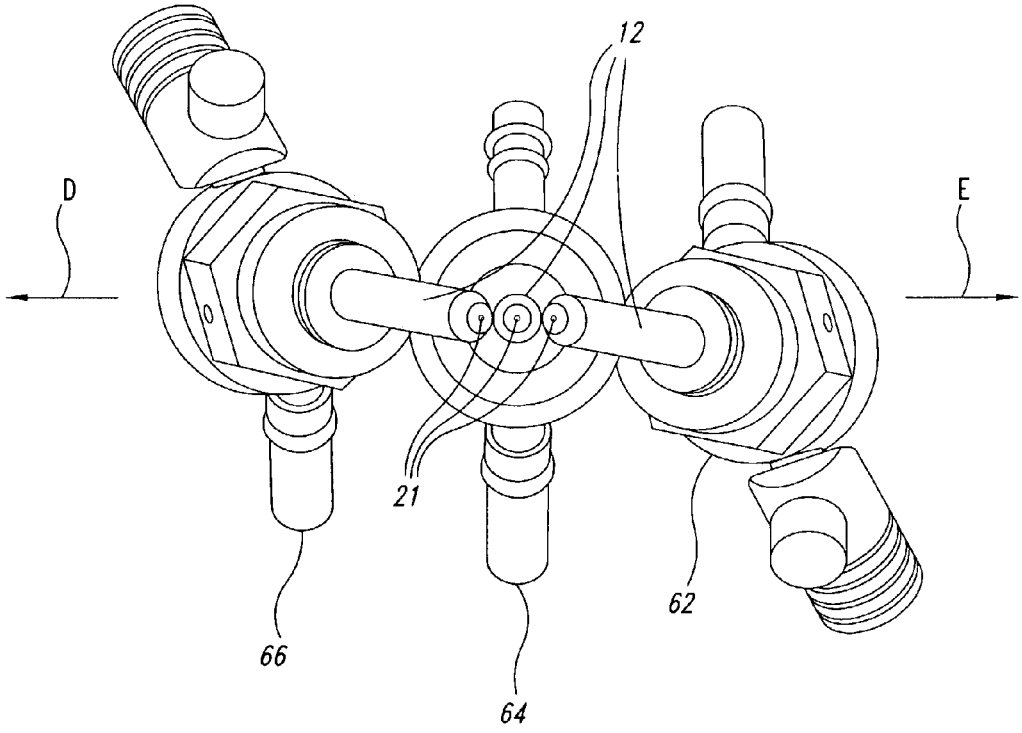
FIG. 9 is a bottom view of the abrasive fluidjet devices as mounted within the multiple jet assembly of FIG. 8A.

FIG. 9 is a bottom view of the AFJDs 62, 64, 66 of the multiple jet assembly 35 of FIG. 8A, showing only the AFJDs and their orientation. The traversing directions are illustrated by the direction of arrows "D" and "E," representing forward and rearward directions. The nozzle 12 of the rear AFJD 62 is disposed such that an abrasive fluidjet discharged from the rear AFJD 62 is imparted with a leading angle as well as a positive lateral angle, the positive lateral angle being slightly upward as viewed in FIG. 9. The central AFJD 64 is disposed so as to emit a vertically aligned abrasive fluidjet with zero lateral angle, and zero longitudinal angle. The forward AFJD 66 is aligned such that an abrasive fluidjet discharged from its nozzle 12 is imparted with a trailing angle, pointed toward the rearward direction "E," as well as negative lateral angle. This arrangement of the AFJDs 62, 64, 66 can provide fast groove milling times as multiple AFJDs are being used simultaneously. Also, the discharge ends 21 of the nozzles 12 are disposed proximate one another to avoid excess nozzle travel along a groove being milled while avoiding intersection of the abrasive fluidjets emitted from the AFJDs. Furthermore, the impingement angles achievable by using the multiple jet assembly 35 are sufficient for milling many of the desired groove shapes discussed above as well as others.

It is noted that any of the AFJDs 62, 64, 66 in the multiple jet assembly 35 can be operated without operating one or more of the other AFJDs. This allows adaptability when a groove shape is desired that requires elimination of one of the impingement angles provided by the multiple jet assembly 35. Also, additional control parameters, such as those previously described for the single AFJD embodiments (e.g. abrasive quality, abrasive flow, and fluid pressure), can also be adjusted for each of the AFJDs 62, 64, 66 of the multiple jet assembly 35, either independently or in combination. Moreover, the AFJDs mounted on the assembly may be configured differently, such as by being provided with different orifice sizes or mixing tube diameters and/or tube lengths or be retained with different standoff distances in the multiple jet mounting assembly.

Referring back to FIG. 8A, the multiple jet assembly 35 includes three retainer pieces 36, 38. Two of the retaining pieces are outer retaining pieces 36, one at a forward portion 56 and one at a rearward 58 portion of the mounting assembly 34, and one is a central retaining piece 38. The retaining pieces 36, 38 are attached to a support portion 40 (which is rectangular in the illustrated embodiment) of a bottom plate 39. Bach of the outer retaining pieces 36 comprises a first section 46 that mates with a second section 48. Each first section 46 is coupled to the corresponding second section 48 by large head screws, bolts, or other fastening mechanisms 49 that are threaded through the first sections 46 and into the second sections 48. The central retaining piece 38 also comprises a first section 52 that mates with a second section 54. Again, each section of the central retaining piece 38 is also attached to the other section by a large head screw, bolt, or other fastening mechanism 49 that is threaded through the first section 52 and into the second section 54. Each of the first and second sections 46, 48, 52, 54 of each of the retaining pieces 36, 38 also includes a recessed portion with a surface contour resembling a half circle, such that when the first and second sections are united, they form a single retaining piece with a bore 50 in a central portion of the retaining piece. The bores 50 are sized to receive the bodies of the AFJDs 62, 64, 66.

Figure 8B:
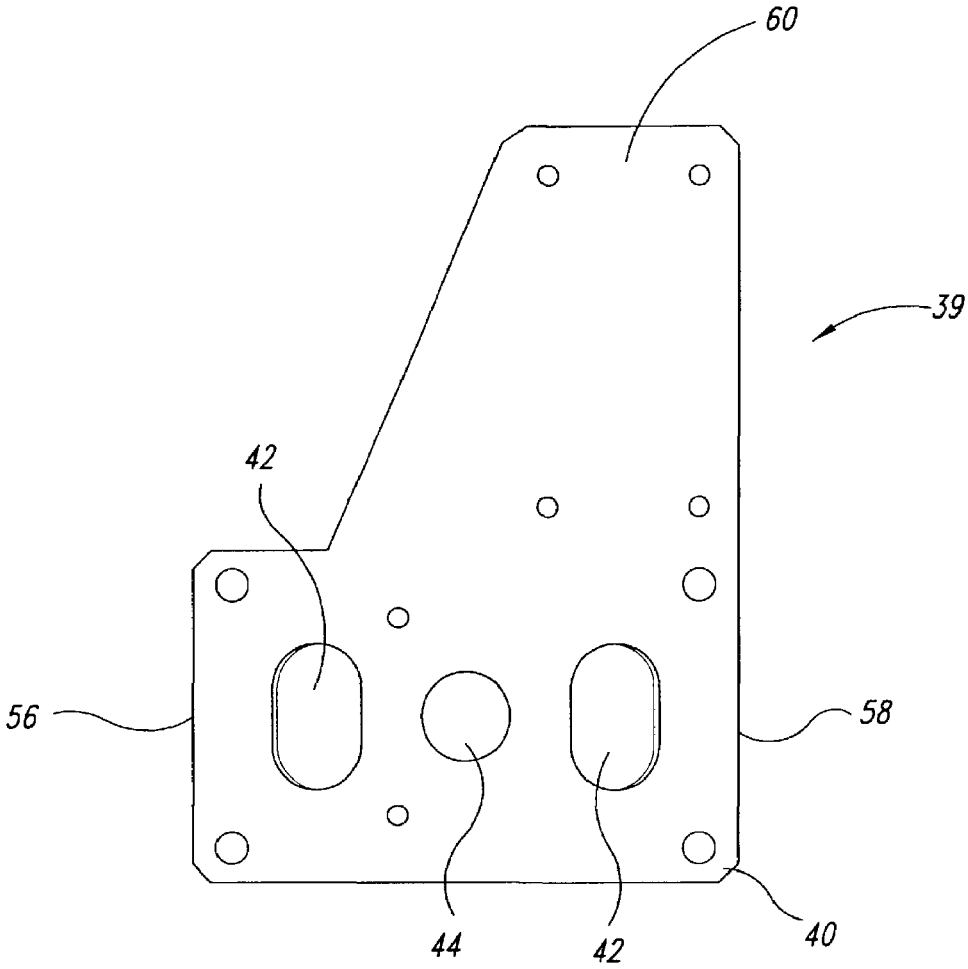
FIG. 8B is a top plan view of a plate of the multiple jet assembly of FIG. 8A.

As can be seen in FIG. 8B, which illustrates a top view of the plate 39, the support portion 40 of the plate comprises three bores, two elongated, or oval shaped outer bores 42, and a central circular bore 44 between the outer bores 42. The retaining pieces 36, 38 (not shown in FIG. 8B) are removably coupled to the top face of the support portion 40 of the plate 39 using screws, with the bores 50 of each of the retaining pieces positioned above one of the corresponding bores 42, 44 of the plate.

The large head screws 49 of the retaining pieces 36, 38 can be loosened to insert the AFJDs 62, 64, 66 within the bores 50 of the retaining pieces, then tightened to secure the AFJDs to the multiple jet mounting assembly 34. Conversely, the large head screws 49 can also be loosened to remove the AFJDs. When the AFJDs 62, 64, 66 are disposed and secured within the retaining pieces, 36, 38 the bottom portions of the AFJDs extend through the corresponding bores 42, 44 of plate 39 downward past the bottom face of the plate 39. The discharge ends 21 of the nozzles 12 are thus disposed below the plate 39.

Figure 8C:
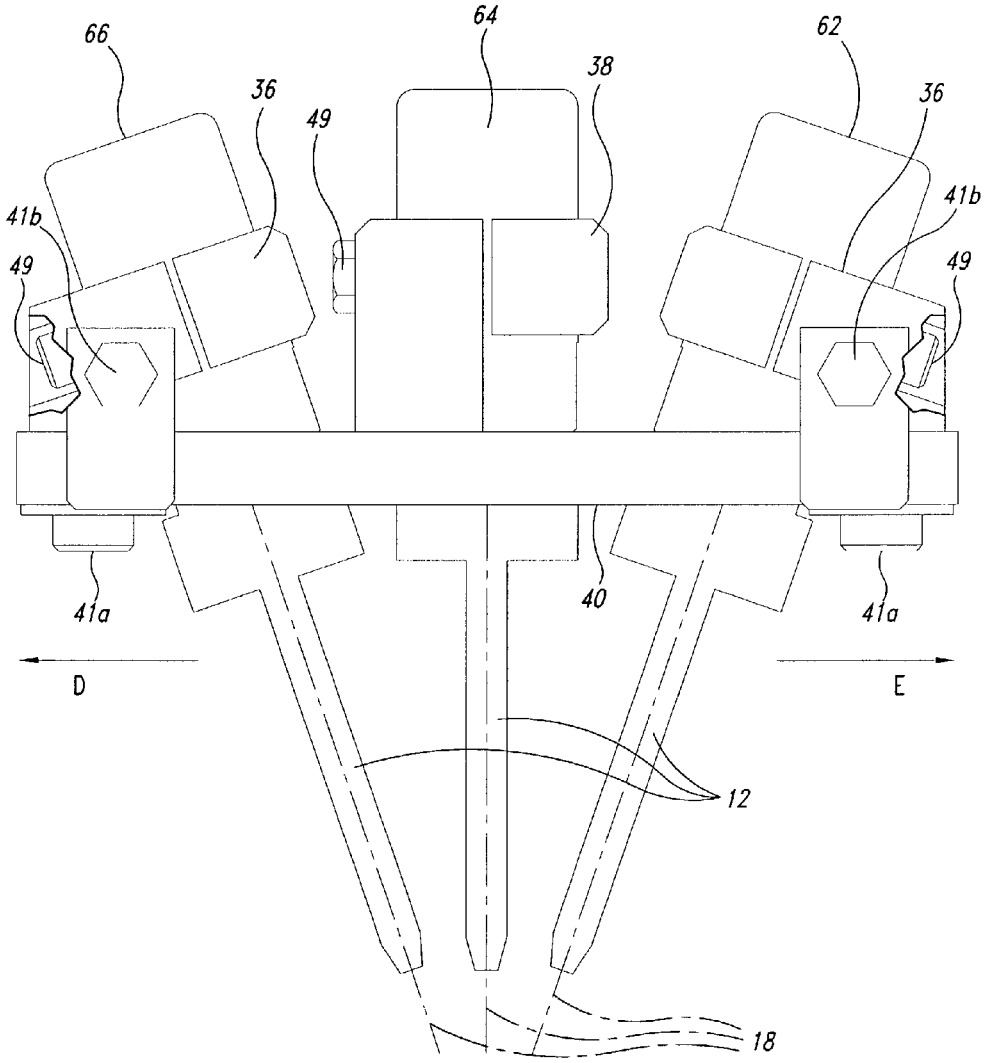
FIG. 8C is a side elevation view of the multiple jet assembly of FIG. 8A.

In some embodiments of the multiple jet assembly 35, the AFJDs 62, 64, 66 are fixedly and non-adjustably coupled to the retainer pieces 36, 38 with a plurality of fastening screws 41*a*, 41*b*, as best seen in FIG. 8C. In these embodiments, the impingement angles of abrasive fluidjets emitted from the AFJDs are pre-selected and non-adjustable. In other embodiments, the multiple jet mounting assembly 34 is configured such that the orientation of the retainer pieces 36, 38 is adjustable to adjust the orientation of the AFJDs 62, 64, 66. As will be appreciated by one skilled in the art upon reviewing this disclosure, various mechanical configurations can be implemented to provided adjustable retaining pieces.

As has been conveyed, the multiple jet assembly 35 is a flexible apparatus that can be used to mill a variety of controlled groove shapes, such as shapes substantially the same as those illustrated in FIGS. 4A–4H. However, some specific control and configuration parameters may be employed as provided below, which provide satisfactory groove shapes for many refiner plate designs:

| Parameter | Value |
|---|---|
| Number of AFJDs 62, 64, 66 Carried in Assembly | three |
| Lateral Angles Employed (degrees) | about 2 to about 3 degrees from vertical in positive (+) or negative (−) direction |
| Longitudinal Angles Employed (degrees) | about 2 to about 20 degrees from vertical in leading or trailing direction |
| Front AFJD 62 and Rear AFJD 66 Stand-Off Distance | about 0.05 to about 0.15 inches |
| Central AFJD 64 Stand-Off Distance | about 0.1 to about 0.5 inches |
| AFJD 62, 64 66 Orifice Size | about 0.005 to about 0.025 inches |
| Mixing Tube (nozzle 12) Diameter | about 0.020 to about 0.100 inches |
| Mixing Tube (nozzle 12) Length | about 2 to about 6 inches |
| Traverse Speed | about 100 to about 600 inches/min |
| Number of Passes to Obtain a 0.16 Inch Deep Groove of 0.16-Inch Width | 24 passes (12 cycles) |
| Number of Passes to Obntain a 0.44 Inch Deep Groove | 26 passes (13 cycles) |

As will be appreciated by one skilled in the art after reading the present disclosure, some of the ranges and values disclosed above can be achieved using various embodiments of the present invention, including either the multiple jet assembly 35 or the single jet embodiments disclosed earlier.

Figure 5A:
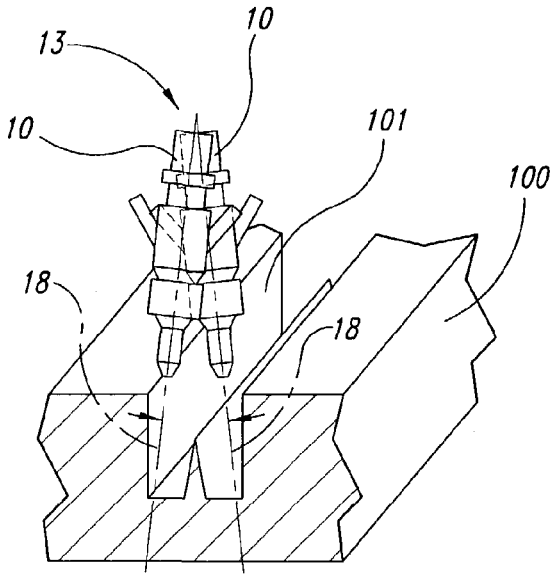
FIG. 5A is an isometric representation of a dual jet apparatus at the end of a pass over a work-piece, with the abrasive fluidjet devices of the apparatus being oriented to provide abrasive fluidjets at positive and negative lateral angles.
Figure 5B:
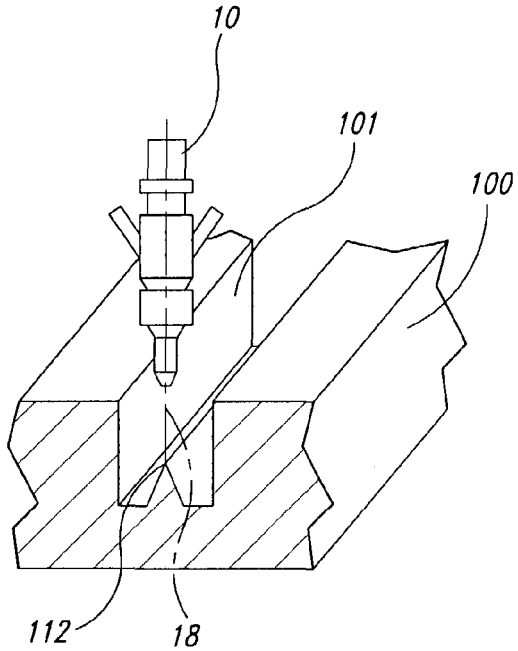
FIG. 5B is an isometric representation of an abrasive fluidjet device at the beginning of a pass over a work-piece, with the abrasive fluidjet being vertically aligned with zero lateral angle.

Furthermore, although a combination of three AFJDs 62, 64, 66 in a single assembly has been disclosed supra, one skilled in the art will appreciate after reviewing this disclosure that other numbers of AFJDs can be combined into a mounting assembly to provide controlled shape groove milling. For example, FIG. 5A shows one embodiment of a dual jet apparatus 13 with two AFJDs 10, one disposed at negative lateral angle and one disposed at a positive lateral angle. A mounting assembly is not shown but can be substantially similar to the multiple jet mounting assembly 34 previously disclosed, but instead, having only two retainer pieces for two AFJDs 10. The dual jet apparatus 13 can be used in combination with a single AFJD, the single abrasive fluidjet 18 emitted therefrom being for removing material from a central portion 112 of the bottom surface of the groove 101, as shown in FIG. 5B. If a manipulator is employed with the dual jet apparatus 13, the single abrasive fluidjet 18 pass can be executed by using only one AFJD 10 of the dual jet apparatus 13 and adjusting the apparatus 13 to provide the required impingement angle and impingement line to mill the center of the groove 101. Also, the use of a single AFJD 10 can be combined with use of the dual jet apparatus 13, wherein the two different jet configurations are carried over the groove at different times during the traversing strategy.

Alternative embodiments of the AFJDs 10, 62, 64, 66, that can be employed with embodiments of the present invention include a long nozzle 12, or mixing tube, to help collimate the abrasive fluidjet 18. Collimating the AFJ 18 can contribute to increased control over the shapes of the grooves. In some embodiments of the present invention, the length of the nozzle 12 is about 200 times the average diameter of an interior axial channel of the nozzle (not illustrated). This can provide improved control over the shape of the grooves, such as providing better wall parallelism.

Figure 10:
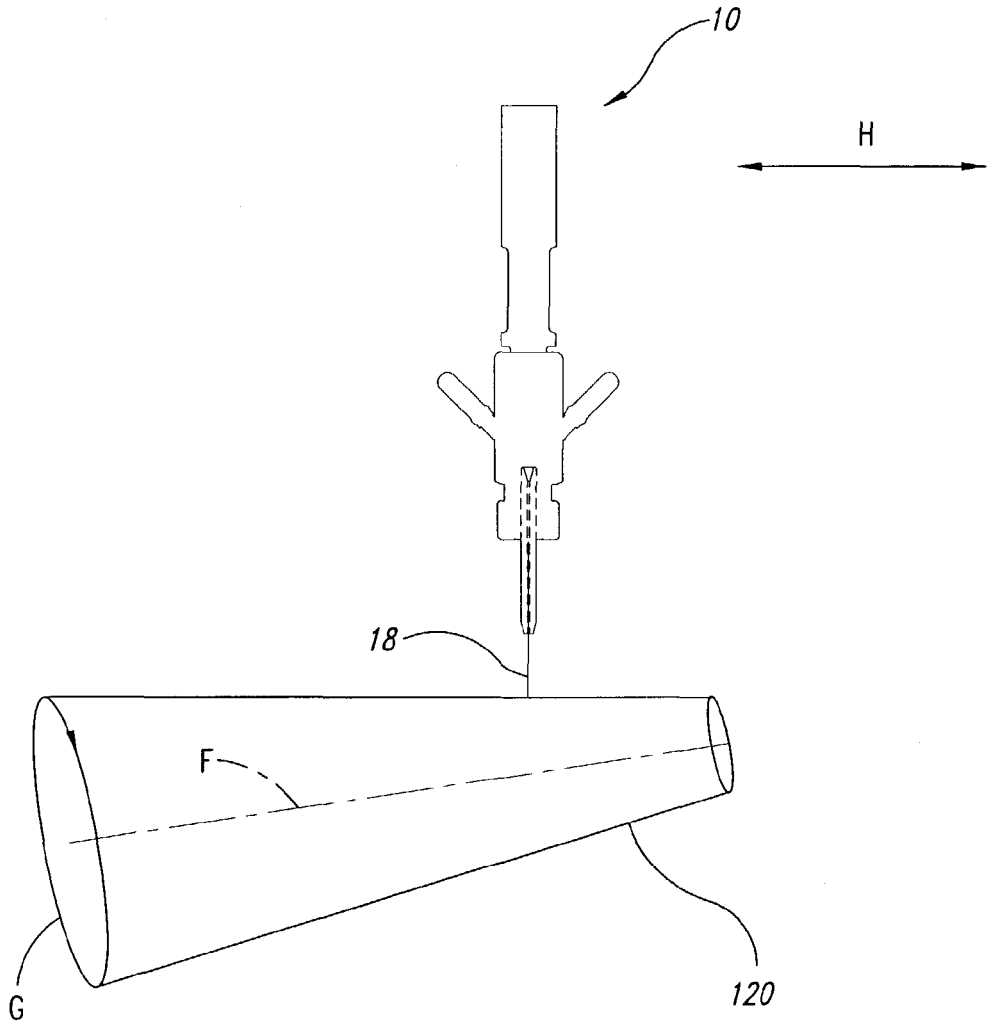
FIG. 10 is a simplified perspective view of an embodiment of the invention as applied to a conical work-piece.

FIG. 10 illustrates some embodiments of the present method that include rotating a conically shaped work-piece 120 about an axis "F" to expose various areas on the surface of the work-piece 120 to an abrasive fluidjet 18. A direction of rotation is indicated in FIG. 10 by the arrow marked "G." The abrasive fluidjet 18 itself can be emitted from a stationary AFJD 10 while the surface of the work-piece 120 is rotated in the direction of arrow "G," to form a circumferential groove (not shown) around the circumference of the work-piece 120. Also, the AFJD 10 can be traversed along the exposed surface of the work-piece 120 in the directions indicated by arrow "H." The work-piece 120 can be rotated to expose a surface, then stopped while a pass is executed with the AFJD 10 along the length of the work-piece 120 in direction "H," to produce a longitudinal groove (not shown). This can be repeated to provide a plurality of longitudinal grooves along the work-piece. The grooves can also be of different lengths, with not all of the grooves extending the entire length of the work-piece 120. Also, the AFJD 10 can be traversed in the directions indicated by arrow "H" at the same time that the work-piece is rotated about the axis "F," to produce helical grooves (not shown) over the surface of the work-piece 120. As will be appreciated by one skilled in the art after reviewing this disclosure, a variety of available systems exist that can be used for rotating the conically shaped work-piece 120 about an axis "F."

Although specific embodiments and examples of the invention have been described supra for illustrative purposes, various equivalent modifications can be made without departing from the spirit and scope of the invention, as will be recognized by those skilled in the relevant art after reviewing the present disclosure. The various embodiments described can be combined to provide further embodiments. The described devices and methods can omit some elements or acts, can add other elements or acts, or can combine the elements or execute the acts in a different order than that illustrated, to achieve various advantages of the invention. These and other changes can be made to the invention in light of the above detailed description.

In general, in the following claims, the terms used should not be construed to limit the invention to the specific embodiments disclosed in the specification. Accordingly, the invention is not limited by the disclosure, but instead its scope is determined entirely by the following claims.

What is claimed is:

1. A method of milling grooves in a work-piece comprising:

providing an abrasive fluidjet device that selectively emits an abrasive fluidjet from the device; and traversing the abrasive fluidjet across a work-piece to form a groove having a selected depth and wall taper in the work-piece, including executing one or more passes along a selected path for the groove with the abrasive fluidjet oriented at a negative lateral angle, executing one or more passes along the selected path with the abrasive fluidjet oriented at a positive lateral angle, and executing one or more passes along the selected path with the abrasive fluidjet oriented at a zero lateral angle.

2. The method of claim 1 wherein the negative and positive lateral angles are between about 2 and about 5 degrees.

3. The method of claim 1 wherein at least one pass is executed with the abrasive fluidjet oriented at a longitudinal angle relative to a direction of traverse.

4. The method of claim 3 wherein the longitudinal angle is about 2 to about 20 degrees.

5. The method of claim 1 wherein an abrasive is mixed with a fluidjet within a mixing tube of the abrasive fluidjet device to produce the abrasive fluidjet, and wherein the mixing tube has a length up to 200 times an average diameter of an axial interior channel of the mixing tube.

6. The method of claim 1 wherein an abrasive is mixed with a fluidjet within a mixing tube of the abrasive fluidjet device to produce the abrasive fluidjet, and wherein the mixing tube has a length of about 4 inches.

7. The method of claim 1 wherein an abrasive is mixed with a fluidjet within a mixing tube of the abrasive fluidjet device to produce the abrasive fluidjet, and wherein the mixing tube has an axial interior channel with a diameter of about 0.020 to about 0.100 inches.

8. The method of claim 7 further comprising passing fluid from a high pressure fluid source through an orifice to generate the fluidjet and wherein the orifice diameter is about 0.005 to about 0.025 inches.

* * * * *